US006637295B2

(12) United States Patent
Weaver

(10) Patent No.: US 6,637,295 B2
(45) Date of Patent: Oct. 28, 2003

(54) CORK REMOVER FOR CHAMPAGNE BOTTLES OR THE LIKE

(76) Inventor: Darryl Weaver, 26650 MacMillan Ranch Rd., Canyon Country, CA (US) 91387

( * ) Notice: Subject to any disclaimer, the term of this patent is extended or adjusted under 35 U.S.C. 154(b) by 0 days.

(21) Appl. No.: 10/043,838

(22) Filed: Jan. 9, 2002

(65) Prior Publication Data

US 2002/0088308 A1 Jul. 11, 2002

Related U.S. Application Data

(60) Provisional application No. 60/260,777, filed on Jan. 10, 2001.

(51) Int. Cl.[7] ..... B67B 7/18

(52) U.S. Cl. ..... 81/3.29; 81/3.39; 81/3.45; 81/3.37; 81/3.33; 81/3.49

(58) Field of Search ..... 81/3.29, 3.39, 81/3.4, 3.41, 3.42, 3.43, 3.44, 3.45, 3.05, 3.07, 3.08, 3.36, 3.37, 3.35, 3.31, 3.33, 3.15, 3.09, 3.32, 121.1, 125, 3.48, 3.49

(56) References Cited

U.S. PATENT DOCUMENTS

| | | | | | |
|---|---|---|---|---|---|
| 1,620,739 | A | * | 3/1927 | Presho | 81/129.5 |
| 1,866,125 | A | * | 7/1932 | Patterson | 81/3.29 |
| 2,761,338 | A | * | 9/1956 | C. Hector-Anthyme Hardy | 81/3.29 |
| 4,018,110 | A | | 4/1977 | Spriggs | |
| 4,052,917 | A | * | 10/1977 | Gee | 81/3.42 |
| 4,074,411 | A | | 2/1978 | Willard et al. | |
| 4,387,609 | A | | 6/1983 | Polsfuss | |
| 4,406,182 | A | | 9/1983 | Antone | |
| 4,422,355 | A | | 12/1983 | Burns, Jr. | |
| 4,442,735 | A | | 4/1984 | Chance et al. | |
| 4,479,406 | A | | 10/1984 | Shoemaker, III | |
| 4,519,277 | A | | 5/1985 | Raab | |
| 4,590,821 | A | * | 5/1986 | Olson | 81/3.37 |
| 4,598,613 | A | | 7/1986 | Baum | |
| 4,606,245 | A | | 8/1986 | Veverka et al. | |
| 4,680,993 | A | * | 7/1987 | Feliz | 81/3.37 |
| 4,708,033 | A | * | 11/1987 | Eash | 81/3.37 |
| 4,729,267 | A | * | 3/1988 | Giebeler | 81/3.37 |
| 4,750,391 | A | | 6/1988 | Sweatt | |
| 4,756,214 | A | * | 7/1988 | Valtri et al. | 81/3.4 |
| 5,016,499 | A | | 5/1991 | Saveland | |
| 5,040,437 | A | | 8/1991 | Mueller | |
| 5,123,310 | A | * | 6/1992 | McManus | 81/125 |
| 5,347,889 | A | * | 9/1994 | St. Denis | 81/3.29 |
| 5,560,269 | A | * | 10/1996 | Zelenka | 81/3.4 |
| 6,286,399 | B1 | * | 9/2001 | Ferster | 81/121.1 |

FOREIGN PATENT DOCUMENTS

| | | | | |
|---|---|---|---|---|
| CA | 451 532 | * | 9/1948 | 81/3.56 |
| CH | 86 828 | * | 10/1920 | 81/3.42 |
| FR | 966 719 | * | 10/1950 | 81/3.56 |
| GB | 589 740 | * | 6/1947 | 81/3.2 |

* cited by examiner

*Primary Examiner*—Joseph J. Hail, III
*Assistant Examiner*—Hadi Shakeri
(74) *Attorney, Agent, or Firm*—John E. Wagner; Robert C. Smith

(57) ABSTRACT

A cork remover for removing corks from bottles, particularly bottles having substantial internal gas pressure, such as champagne bottles, includes a tapered, generally tubular part, which is placed over the shoulder of the bottle. A hollow, threaded, tubular member is secured to the tapered part and is threaded to a tubular sleeve which has ports on opposite sides of its sidewall. Sharpened pins are movable through the ports to puncture and hold the cork. In one embodiment, the pins are threaded to the sleeve and are turned into the cork by means of handles secured to the pins. In another embodiment, the pins are replaced with C-shaped members having abrasive surfaces which are pressed into the sides of the cork, enabling it to be turned by use of the handles. Further embodiments utilize an L-shaped handle pivotally secured to the sleeve to force one or both pins into the corks. The handle can then be turned to break the cork loose and enable it to be removed.

13 Claims, 3 Drawing Sheets

FIG. 1
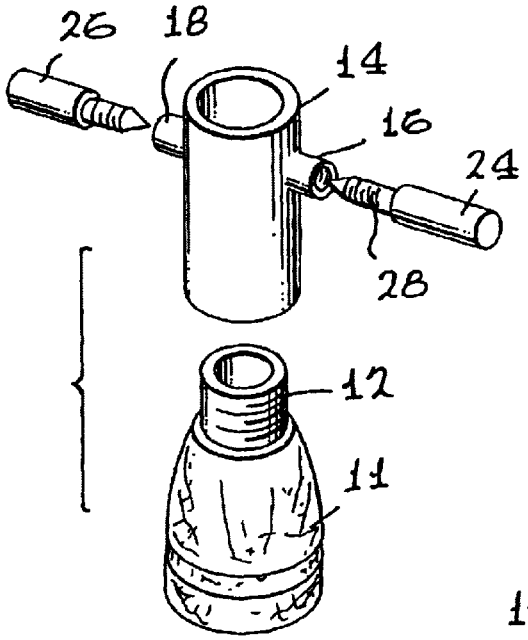
FIG. 3
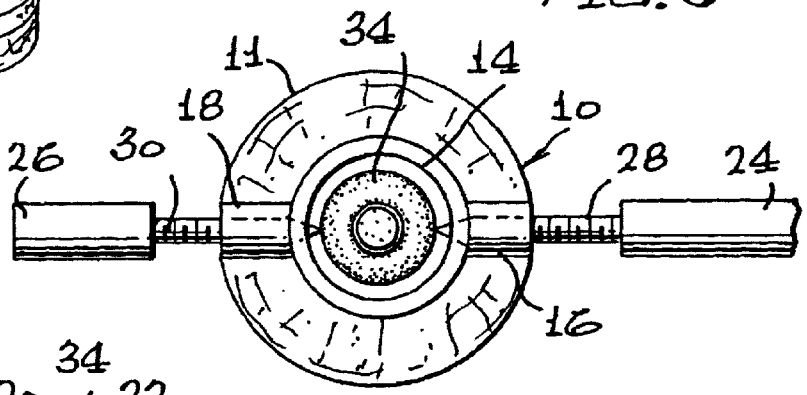
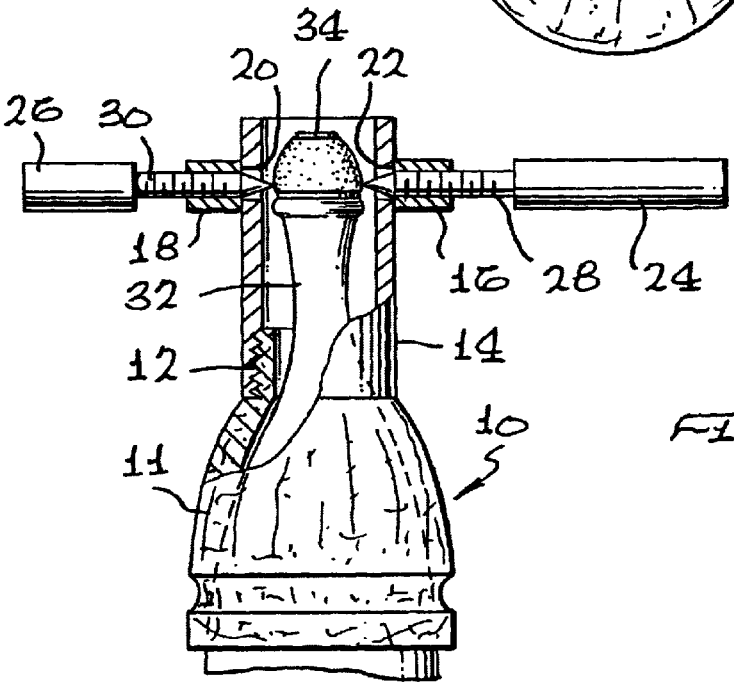
FIG. 2

FIG. 4
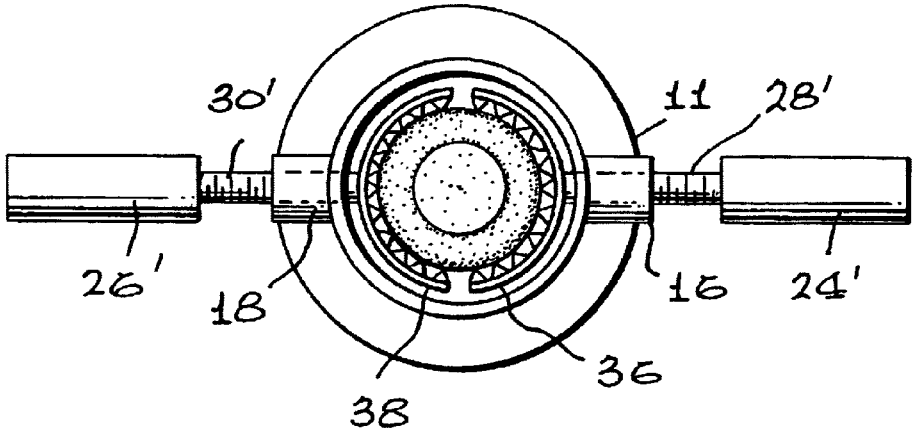
FIG. 5
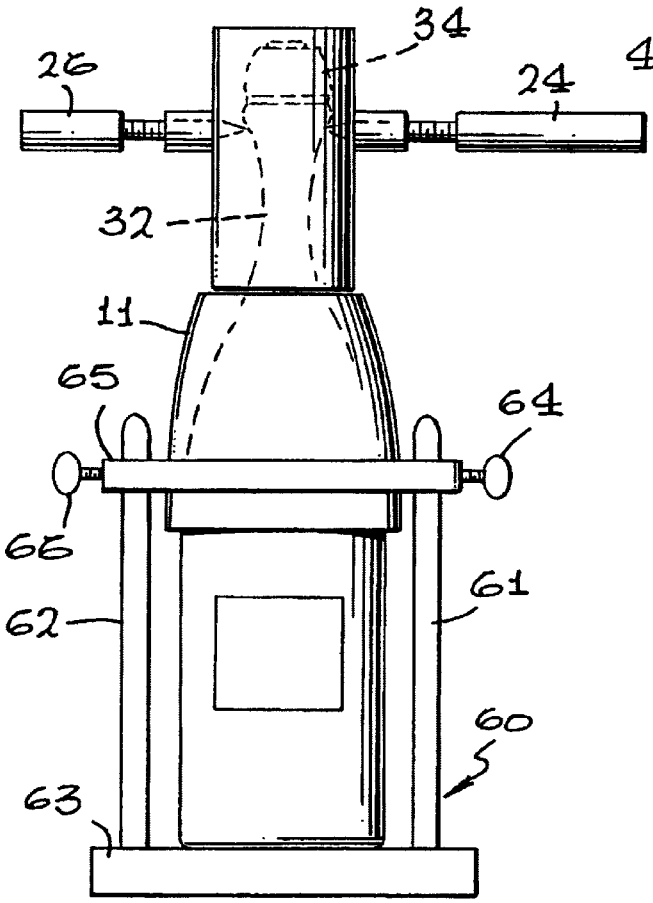
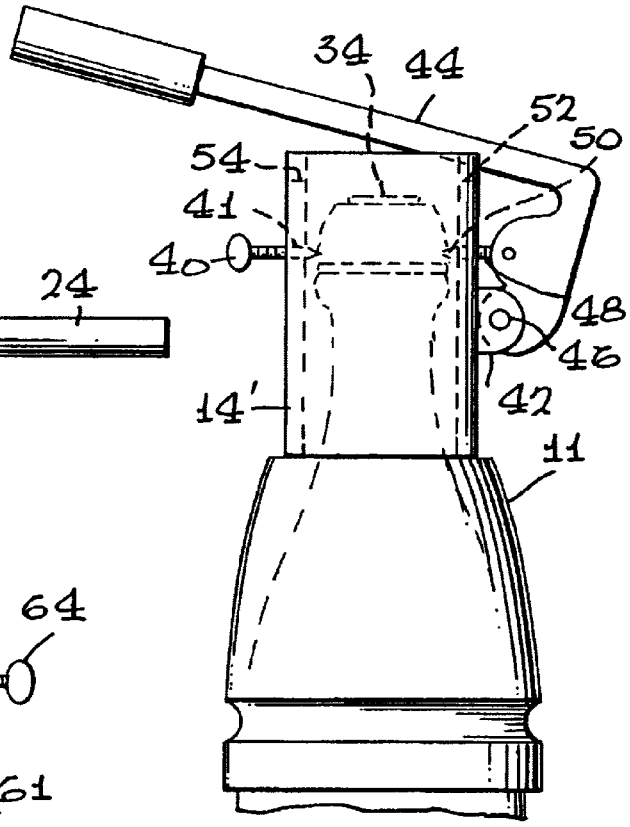
FIG. 6

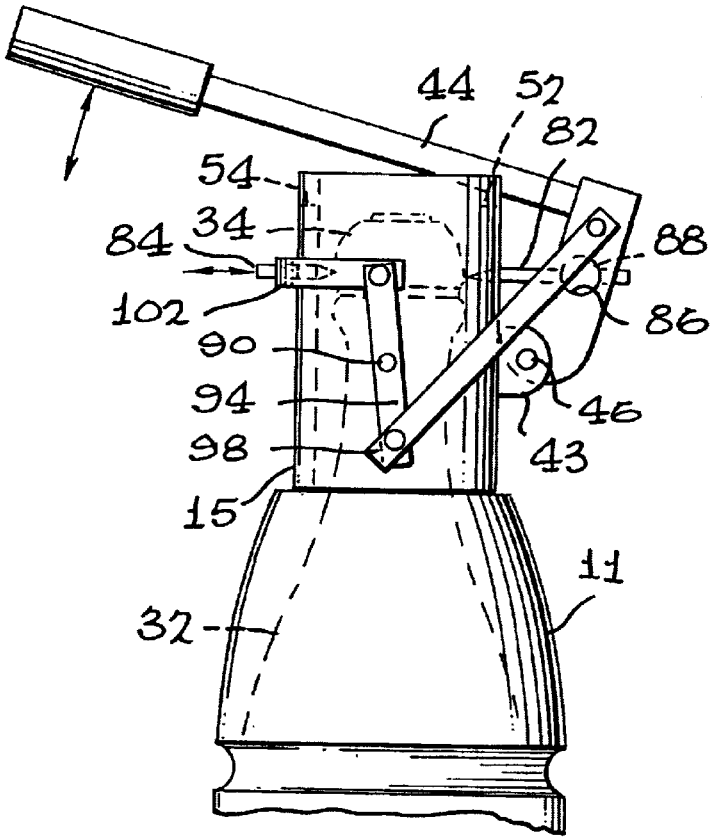
FIG. 7
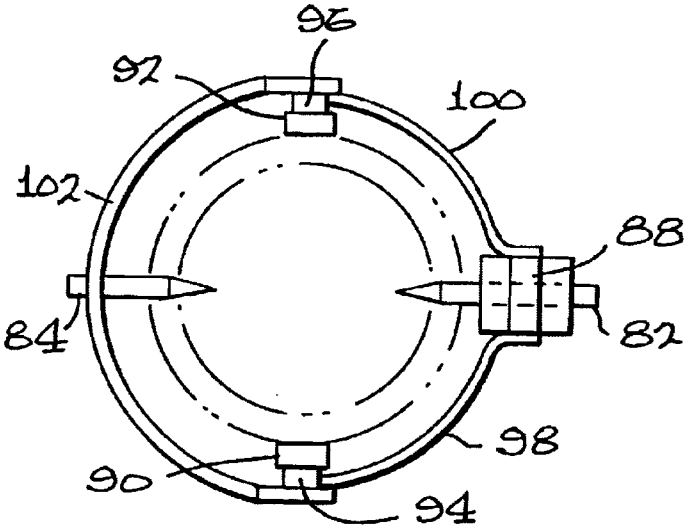
FIG. 8
FIG. 9
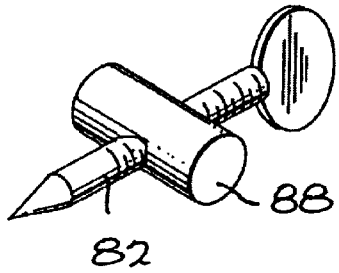

CORK REMOVER FOR CHAMPAGNE BOTTLES OR THE LIKE

REFERENCE TO RELATED APPLICATION

This non-provisional patent application claims benefit of U.S. provisional patent application Serial No. 60/260,777, filed Jan. 10, 2001, and hereby claims the benefit of the embodiments therein and of the filing date thereof.

BACKGROUND OF THE INVENTION

This invention relates to a device for removing overhanging closures for champagne bottles commonly and hereafter referred to as "corks", although often produced of natural cork or plastic. Because of the gas force built up inside champagne bottles, some care is required after removal of any wire or other restraint in removing the cork from the bottle to avoid having it suddenly pop out of the bottle, possibly striking someone. Also, such sudden opening of the bottle often results in a significant waste of the contents.

There have been a number of devices for opening champagne bottles, such as a simple corkscrew and more complicated corkscrew devices, which include a gear and handle arrangement for removing the cork. Such devices have disadvantages, such as damaging the cork with the result that pieces of cork fall into the champagne. A somewhat complicated form of cork puller is shown in U.S. Pat. No. 4,422,355 in which a bracket is secured to a collar, which is secured around the neck of the bottle, and which abuts against an annular projection at the top of the bottle neck. A clamp device within the collar is secured to the cap or cork. A threaded shaft, which is threadedly engaged with a cross-piece at the top of the bracket is secured to the clamp device. A "T" handle at the top of the threaded shaft is turned to lift the cap and cork out of the bottleneck.

What is needed is a champagne cork remover, which is easy to operate, and which removes the cork smoothly and safely with little danger of damaging the cork or losing a substantial part of the champagne in the bottle.

BRIEF SUMMARY OF THE INVENTION

A cork remover for removing corks from bottles, particularly champagne bottles and other bottles containing gas under pressure includes a tapered generally tubular part which slips over the neck of the bottle and rests on the curved shoulder part of the bottle. Secured to this part is a collar, which is threadedly engaged with a sleeve encircling the neck. The sleeve incorporates a pair of ports through which are inserted a pair of sharpened pins which penetrate the cork.

In one embodiment, the pins are threaded to the sleeve and handles are secured to the pins which, after removal of the securing wire, if any, enable one to twist the cork to loosen it and enable the cork to be removed. By maintaining a good grip on the handles, a sudden ejection of the cork can be prevented along with the usual loss of contents. A modification of this embodiment incorporates a stand for holding the bottle in position while the cork is being removed.

A second embodiment is like that described above except that, rather than using the handles to force threaded pins into the cork, the handles are connected to C-shaped members having abrasive or toothed internal surfaces which are forced against the cork to hold it while it is turned by the handles.

Another embodiment incorporates an L-shaped handle pivotably secured to the sleeve which provides substantial leverage to force an attached sharpened pin into the cork. A second sharpened pin is threadedly engaged with the sleeve and manually turned into the cork. A further embodiment uses a handle as described above for forcing one pin into the cork and also incorporates a link and lever arrangement which responds to a downward movement of the handle by forcing the second pin into the opposite side of the cork.

BRIEF DESCRIPTION OF THE DRAWINGS

This invention may be more clearly understood with the following description and by reference to the drawings in which:

FIG. 1 is an exploded view of the champagne cork remover of the present invention;

FIG. 2 is a side elevational view, partly in section, of the cork remover of FIG. 1 as installed on a champagne bottle;

FIG. 3 is a top plan view of the cork remover of FIG. 2;

FIG. 4 is a top plan view of an alternate embodiment of the invention;

FIG. 5 is a side elevational view of a further embodiment of the invention;

FIG. 6 is a side elevational view of a still further embodiment of the invention;

FIG. 7 is a side elevational view of a still further embodiment of the invention;

FIG. 8 is a top view, partly in section, of the embodiment of FIG. 7; and FIG. 9 is a perspective view of a pin assembly of FIGS. 7 and 8.

DETAILED DESCRIPTION

Referring now to FIGS. 1 and 2, the cork remover 10 of the present invention includes, as shown in FIG. 1, a tapered generally tubular part 11 which fits over the top of the bottle and sits on the curved shoulder part of the bottle. Part 11 may be of any suitable material, such as wood or plastic, and secured to its top is a tubular member 12, preferably of brass, which has external threads. A sleeve 14, which is preferably of brass, is tubular and includes internal threads which mate with threads of tubular member 12. It is within the contemplation of this invention that part 11 and tubular member 12 may be fabricated as a single piece.

The upper part of sleeve 14 includes a pair of integrally attached, transversely positioned, hollow cylindrical members 16 and 18, which are internally threaded and which are aligned with ports 20 and 22, respectively, (FIG. 2) in the side wall of sleeve 14.

A pair of handles 24 and 26 include threaded extensions 28 and 30, respectively, which mate with internal threads in cylindrical members 16 and 18.

FIG. 2 is a side elevational view of the cork remover 10 of FIG. 1 shown partly in section and after removal of the retaining wire. This view shows part 11 supported on the shoulder of a bottle 32 with the tubular member 12 threadedly engaged with the sleeve 14. Extensions 28 and 30 of handles 24 and 26 are threaded into members 16 and 18, with pointed ends adapted to pierce the cork 34.

FIG. 3 is a top view of the cork remover 10 shown in FIG. 2. The part 11 and the tubular brass sleeve 14 with the hollow cylindrical members 16 and 18 are shown. Threaded extensions 28 and 30 are shown by dashed lines passing through members 16 and 18, respectively, with the pointed ends of extensions 28 and 30 advanced inwardly until they pierce the opposite sides of cork 34. With the cork 34 thus constrained, it will rotate as handles 24 and 26 are turned and can readily be removed from the neck of the bottle 32. Once loosened, the cork 34 will tend to be forced out by the force of the gas in the bottle. A person opening the bottle and holding handles 24 and 26 has a good grip on the cork to prevent its blowing out suddenly.

FIG. 4 is a top view of an alternate embodiment of my cork remover in which some parts are the same as in FIGS. 1–3 and are given the same numerals. The tubular part 11 is the same as part 11 of FIGS. 1–3 as is the sleeve 14 with the hollow internally threaded members 16 and 18. Extension members 28' and 30', rather than piercing the sides of cork 34 directly, are rotatably secured to a pair of generally opposing C-shaped clamps 36 and 38, which are positioned inside of sleeve 14.

Turning extension members 28' and 30' inward causes clamps 36 and 38 to be clamped around the cork 34. While the inside surfaces of clamps 36 and 38 are shown with teeth which would engage and hold the surface of cork 34, other surfaces would also be effective to avoid slippage of clamps 36 and 38, such as surfaces like coarse sandpaper or emery paper. Following securing of clamps 36 and 38 against cork 34, the handles 24' and 26' are turned to easily and smoothly remove the cork 34 from the neck of the bottle 32 (FIG. 2). The length of the handles is sufficient to provide adequate leverage to prevent sudden releasing of the cork from the gas pressure in the bottle.

FIG. 5 is a side elevational view of an embodiment similar to that of FIGS. 1–4 but incorporating a stand for holding the bottle 32 in position while the cork 34 is being removed. Since some people might find it difficult or awkward to hold the skirt member 11 and bottle 32 in position while they operate handles 24 and 26, a stand 60 is provided secured to a table or counter by a clamp, not shown. Stand 60 includes a pair of upright posts 61, 62, a base 63 and a ring 65. Stand 60 would also be useful in connection with the embodiment of FIG. 5.

Ring 65 includes a pair of finger-operated screws 64, 66. With the bottle 32 placed on the stand as shown, and with the skirt part 11 firmly seated on the shoulder of the bottle 32 and secured in position by screws 64, 66, the operator will have both hands available to turn handles 24 and 26, while at the same time being able to push downwardly to resist the force of the gas pressure inside bottle 32, thus avoiding any explosive ejection of the cork 34 and accompanying loss of some the contents of the bottle.

FIG. 6 is a side elevational view of a further embodiment of the cork remover of the invention. In this embodiment, the tapered tubular part 11 is as described above. Threadedly engaged with part 11 is a sleeve 14', which is significantly modified from sleeve 14 of FIGS. 1–4 in that it includes a thumb and finger operated screw 40 passing through a threaded port 41 in its sidewall, screw 40 having a point adapted to pierce the side of cork 34. On the other side of sleeve 14' is a radially extending lug 42 to which is pivotally secured an "L"-shaped handle 44. At a limited distance from the pivot point 46 where the handle 44 is attached to lug 42 is a mounting for a pivotally attached pin 48 which passes through a port 50 in the side of sleeve 14'. As the handle 44 is moved downwardly as shown by the arrow, pin 48 will be forced into the cork 34 such that the cork is pierced on opposite sides and thereby firmly held. One holding handle 44 and member 11 can then rotate the handle in a direction perpendicular to the plane of the paper to loosen and remove cork 34. Again, in this embodiment the cork is held quite securely so that an explosive release of the cork is easily avoided. One or more slots 52, 54 may be formed in the top of sleeve 14' to provide clearance to move handle 44 downwardly as desired.

FIG. 7 is a modified form of the embodiment of FIG. 6 in which actuation of handle 44 simultaneously causes sharpened pins 82 and 84 to penetrate the cork 34.

FIG. 8 is a top view, partly in section, of the embodiment of FIG. 7 with handle 44 removed.

Part 11 is as described above. Sleeve 15 supports sharpened pins 82 and 84 and includes radially projecting lug 43 to which is secured the L-shaped handle 44. Spaced from pivot point 46, where handle 44 is attached to lug 43, is a bore 86 supporting a rotatable pin 88. Pin 88 is drilled and tapped to receive threaded and sharpened pin 82 as shown in FIG. 9.

Also secured to sleeve 15 are pivot pins 90 and 92 supporting levers 94 and 96, respectively, which are pinned to curved links 98 and 100, both of which are secured to handle 44. Secured to the opposite ends of levers 94 and 96 is a semi-circular bracket 102 which is bored to receive pin 84.

Once the retaining wire is removed from bottle 32, tapered tubular member 11 is slipped over the shoulder of bottle 32 with sleeve 15 secured thereto as described above. With handle 44 in raised position, pins 82 and 84 are spaced away from cork 34. As handle 44 is pushed downwardly, as shown by the arrow, it pivots around pivot point 46, pushing curved links 98 and 100 down as seen in FIG. 7 and causing levers 94 and 96 to rotate clockwise carrying bracket 102 toward the right and forcing pin 84 into cork 34. At the same time, handle 44 forces sharpened pin 82 into the opposite side of cork 34. Handle 44 will then sit in the notches 52 and 54 at the top of sleeve 15. One can then move the handle 44 counterclockwise, rotating sleeve 15 and unscrewing it from part 11, which twists and pulls the cork 34 upwardly. Loosening and rotating the cork, which is also subject to force from the internal gas pressure will tend to force the cork out of the bottle. The operator, by maintaining a good grip on handle 44 and part 11, will be able to control the ejection of the cork and avoid a significant loss of the contents of the bottle.

While the above invention has been described in connection with opening of champagne bottles, it will be understood that applicant's cork remover would be similarly useful in removing corks from other bottles, particularly those containing liquids carrying entrained gas under pressure such as various sparkling wines or non-alcoholic, highly carbonated drinks.

The above-described embodiments of the present invention are merely descriptive of its principles and are not to be considered limiting. The scope of the present invention instead shall be determined from the scope of the following claims including their equivalents.

I claim:

1. A cork remover for removing a cork having an overhanging head from a champagne-type bottle having a shoulder comprising:

a tapered generally tubular part which fits over the shoulder of the bottle including an externally threaded portion;

a tubular sleeve which is threadedly engaged with said threaded portion and which extends above a height of said bottle, said sleeve including radial ports on opposite sides thereof aligned with the overhanging head of said cork;

and means engaged with said ports and movable in a longitudinal axis to apply pressure to opposite sides of the head of said cork and wherein said tubular sleeve is rotatable about an axis perpendicular to said longitudinal axis for turning and removing said cork in said bottle.

2. A cork remover as claimed in claim 1 wherein said means movable to apply pressure to opposite sides of said cork includes generally C-shaped members having rough surfaces movable to contact said cork and handles extending from said C-shaped members for turning said cork.

3. A cork remover as claimed in claim 1 wherein said movable means comprises a tubular sleeve having internal threads aligned with each of said ports, a sharpened, threaded pin threadedly engaged with each of said ports and handles for turning said pins into said cork and for turning said cork in said bottle.

4. A cork remover as claimed in claim 1 wherein said sleeve includes a top edge, said means for rotating said pins includes an L-shaped handle pivotally secured to said sleeve, slots are formed in the top edge of said sleeve and said handle is movable to drive at least one of said pins into said cork, said handle being further movable into said slots to enable rotating said cork in said bottle.

5. A cork remover for removing a cork having an overhanging head from a champagne-type bottle having a curved shoulder comprising:

a tapered generally tubular part which fits over the shoulder of the bottle;

a tubular threaded member secured to said tubular part;

a tubular sleeve having a sidewall which is threadedly engaged with said threaded member and which extends at or above the height of said bottle, said sleeve including a pair of diametrically opposed radially directed ports on opposite sides thereof aligned with said cork;

a pair of sharpened pins at least one of which is movable in a longitudinal axis through one of said ports to penetrate the overhanging head of said cork, and means operatively connected to said sharpened pins for rotating said pins to turn about an axis perpendicular to said longitudinal axis for turning said cork in said bottle; and whereby threadable movement of said tubular sleeve with respect to said tubular threaded member in one direction rotates the cork and withdraws the cork from the bottle.

6. A cork remover as claimed in claim 5 wherein one of said sharpened pins is threadedly engaged with said tubular sleeve and manually rotatable to penetrate the overhanging top of said cork, an L-shaped pivotable handle is pivotally secured to said sleeve, a second sharpened pin is secured to said handle in alignment with one of said ports whereby moving said handle in a first direction causes said second sharpened pin to penetrate said cork; and moving said handle in a second direction pulls said second sharpened pin out of said cork.

7. A cork remover as claimed in claim 6 wherein said sleeve has a top edge and slots are formed in said top edge for receiving said handle.

8. A cork remover as claimed in claim 5 further comprising:

a handle pivotally secured to said sleeve, a first one of said sharpened pins being pivotally secured to said handle and aligned with one of said ports;

a second sharpened pin aligned with the other of said ports;

a C-shaped bracket supporting said second sharpened pin;

a pair of levers pivotally secured to said sleeve;

a pair of links, each of which is secured at one end to said handle and at another end to an end of one of said levers, an opposite end of said levers being secured to opposite ends of said C-shaped bracket;

whereby moving said handle in a first direction drives said first sharpened pin into said cork and causes said links to rotate said levers in a direction to move said C-shaped bracket toward said cork, forcing said second sharpened pin into said cork and moving said handle in the opposite direction pulls said sharpened pins out of said cork.

9. A cork remover as claimed in claim 5 wherein said means for rotating said pins further comprises:

a pair of diametrically opposed levers pivotally secured to said sidewall of said sleeve;

an L-shaped handle pivotally secured to a sidewall of said sleeve;

a C-shaped bracket having its ends secured to one end of each of said levers;

a pair of links attached to said L-shaped handle and to the opposite ends of said levers;

said one of said sharpened pins being secured to said L-shaped lever and the other of said sharpened pins being secured to said C-shaped bracket whereby moving said handle in a first direction forces one of said sharpened pins into said cork and causes said links to rotate said levers in a direction to move said C-shaped bracket toward said cork, forcing another of said sharpened pins into said cork; and moving said handle in an opposite direction pulls said sharpened pins out of said cork.

10. A cork remover as claimed in claim 5 wherein said means for rotating said pins comprises an L-shaped handle pivotally secured to the sidewall of said sleeve, one of said sharpened pins being secured to said handle;

a C-shaped bracket having opposite ends with the other of said sharpened pins secured to said bracket;

a pair of levers having first and second ends secured to the sidewall of said sleeve and each lever having its first end connected to an end of said C-shaped bracket;

and links connected between said handle and a second end of each of said levers opposite to said first ends;

whereby moving said L-shaped handle in a first direction drives said sharpened pins into said cork and moving said handle in an opposite direction pulls said sharpened pins out of said cork.

11. A cork remover for removing a cork having an overhanging head from a champagne-type bottle having a shoulder comprising:

a sleeve defined by an annular sidewall fitting over the top of said bottle;

a pair of diametrically opposed ports in the sidewall of said sleeve directed toward said cork;

a pair of sharpened pins aligned to pass through said ports;

means movable to drive said pins into said cork and rotatable to cause said cork to rotate in said bottle;

said movable means including:

a pair of diametrically opposed levers having opposite ends secured to the sidewall of said sleeve;

an L-shaped handle pivotally secured to the sidewall of said sleeve;

a C-shaped bracket having its ends secured to one end of each of said levers;

a pair of links attached to said L-shaped handle and to the opposite ends of said levers;

one of said sharpened pins being secured to said L-shaped lever and another of said sharpened pins being secured to said C-shaped bracket whereby moving said handle in a first direction forces said sharpened pins into said cork;

moving said handle in the opposite direction pulls said sharpened pins out of said cork; and whereby rotating said L-shaped handle about the neck of the bottle rotates the cork for removal from said bottle.

12. A cork remover as claimed in claim 11 wherein said sleeve includes a top edge and slots are formed in the top edge of said sleeve for receiving said handle such that said handle may be rotated in a plane perpendicular to said first direction to cause said cork to be rotated in said bottle.

13. A cork remover as claimed in claim 10 wherein said sleeve includes a top edge and slots are formed in the top edge of said sleeve for receiving said handle such that said handle may be rotated in a plane perpendicular to said first direction to cause said cork to be rotated in said bottle.

* * * * *